United States Patent [19]

Bleecker et al.

[11] Patent Number: 4,655,795

[45] Date of Patent: Apr. 7, 1987

[54] ABRASIVE TOOL FOR HONING

[75] Inventors: William H. Bleecker, Union Lake; William G. Corley, Dearborn Heights, both of Mich.

[73] Assignee: Ex-Cell-O Corporation, Troy, Mich.

[21] Appl. No.: 470,129

[22] Filed: Feb. 28, 1983

[51] Int. Cl.[4] ..... B24D 3/02

[52] U.S. Cl. ..... 51/309; 51/293

[58] Field of Search ..... 51/293, 309

[56] References Cited

U.S. PATENT DOCUMENTS

| | | | |
|---|---|---|---|
| 2,811,960 | 11/1957 | Fessel | 51/309 |
| 2,828,197 | 3/1958 | Blackmer, Jr. | 51/309 |
| 3,239,321 | 3/1966 | Blainey, Jr. | 51/309 |
| 3,372,010 | 3/1968 | Parsons | 51/309 |
| 3,389,981 | 6/1968 | Strauss, Jr. | 51/293 |
| 3,496,682 | 2/1970 | Quass et al. | 51/309 |
| 3,594,141 | 7/1971 | Houston et al. | 51/295 |
| 3,596,649 | 8/1971 | Olivieri | 51/309 |
| 4,142,872 | 3/1979 | Conradi | 51/309 |
| 4,311,490 | 1/1982 | Bovenkerk et al. | 51/309 |

*Primary Examiner*—Paul Lieberman
*Assistant Examiner*—Willie J. Thompson
*Attorney, Agent, or Firm*—Edward J. Timmer

[57] ABSTRACT

The ratio of stock removal to tool wear (G ratio) of an abrasive tool having a copper-tin bond alloy with diamond abrasive grit dispersed therein is more than doubled when honing cast iron by including titanium carbide particulate in the bond alloy in an amount of about 0.5 weight percent to less than 20 weight percent, preferably from about 1 to 5 weight percent, based on the total weight of copper and tin.

4 Claims, 1 Drawing Figure

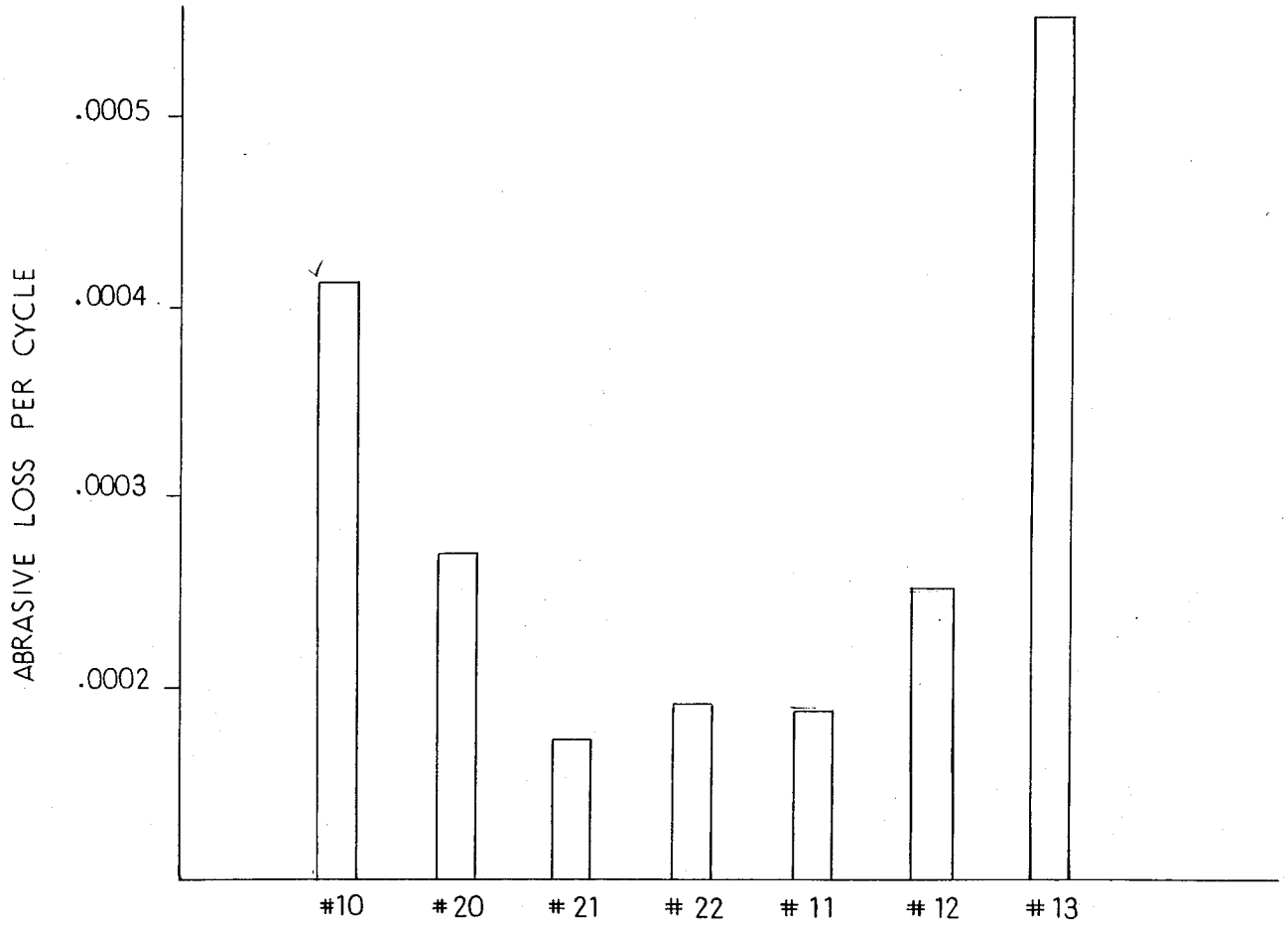
ABRASIVE LOSS PER CYCLE
.0005
.0004
.0003
.0002
#10
#20
#21
#22
#11
#12
#13

ABRASIVE TOOL FOR HONING

FIELD OF THE INVENTION

The present invention relates to abrasive tools useful for honing and sizing workparts.

BACKGROUND OF THE INVENTION

Metal bonded abrasive tools for honing bores in workparts are known in the art. For example, a metal bonded diamond tool is disclosed in U.S. Pat. No. 3,594,141 issued July 20, 1971 to Houston et al. The tool is described as including a backing element made of iron and bronze (copper-tin) sintered powder and a stone element thereon. The stone element comprises a bond or matrix alloy which is a sintered mixture of cobalt and tungsten carbide powders with other refractory carbides such as titanium carbide, chromium carbide, tantalum carbide or vanadium carbide optionally present and further comprises diamond grits held in the bond alloy. The ratio of carbide to cobalt in the bond alloy is varied from 20 weight percent to 90 weight percent inversely with cobalt from 80 weight percent to 10 weight percent in the bond alloy. The honing tool is subjected to a two stage sintering treatment such that the bronze component of the backing element is caused to liquify and infiltrate the matrix of the stone element. Upon cooling, the bronze infiltrant solidifies in the matrix of cobalt and tungsten and other carbides, occupying about 30% of the volume of the stone element.

U.S. Pat. No. 4,142,872 issued Mar. 6, 1979 to Conradi also describes a metal bonded abrasive tool which comprises a bonding matrix of sintered borided cobalt powder with optional fillers such as tungsten carbide, and diamond or cubic boron nitride abrasive particles held in the bonding matrix. The cobalt powder and abrasive particles are sintered together with the boriding of the cobalt being conducted prior to or during the sintering treatment.

U.S. Pat. No. 3,496,682 issued Feb. 24, 1970 to Quaas et al. describes a flame sprayable alloy composition for producing cutting and/or wear surfaces on substrates. The flame sprayable composition includes a matrix system of nickel, cobalt or copper base and diamond abrasive bort entrapped in the matrix as the composition is sprayed on the substrate. Refractory carbides such as tungsten, titanium, chromium, zirconium and molybdenum carbides may be mixed with the diamond bort in an amount of 1 to 50 percent by weight. The matrix system must melt below 2400° F. and to this end nickel base alloys, cobalt base alloys and copper base alloys of the copper-silicon and copper-tin type are employed.

Other abrasive tools or articles are disclosed in U.S. Pat. No. 3,596,649 issued Aug. 3, 1971 to Olivieri, U.S. Pat. No. 4,308,035 issued Dec. 29, 1981 to Danilova et al. and U.S. Pat. No. 4,311,490 issued Jan. 19, 1982 to Bovenkerk et al. Methods for producing abrasive articles or individual abrasive grains are illustrated in U.S. Pat. No. 3,389,981 issued June 24, 1968 to Strauss, U.S. Pat. No. 3,785,938 issued Jan. 15, 1974 to Sam, U.S. Pat. No. 4,024,675 issued May 24, 1977 to Vladimicrovich et al. and U.S. Pat. No. 4,184,853 issued Jan. 22, 1980 to Otopkvov et al.

SUMMARY OF THE INVENTION

In a typical working embodiment, the present invention provides an abrasive tool comprising a metal bond alloy or matrix of copper, tin and optionally cobalt in which titanium carbide particulate is included in an amount from about 0.5 weight percent but less than 20 weight percent, preferably about 0.5 to 10 weight percent, and even more preferably about 1 to 5 weight percent based on the total metal alloy weight to significantly increase the G ratio (i.e., ratio of stock removal to tool wear) during honing. Diamond and/or cubic boron nitride abrasive grit is also held in the bond alloy.

BRIEF DESCRIPTION OF THE DRAWING

The FIGURE is a bar graph showing abrasive loss per cycle (tool wear) of tools in honing cast iron.

DESCRIPTION OF PREFERRED EMBODIMENTS

Abrasive tools of the invention include a copper-tin or copper-tin-cobalt bond alloy or matrix to which is added titanium carbide in critical amounts. Abrasive grit in the form of diamond and/or cubic boron nitride particulate is held in the bond alloy. The Table hereinbelow sets forth the composition of the bond alloy for certain abrasive tools which were subjected to honing tests of cast iron as described in detail below. The tools represented in the Table each had diamond particulate dispersed throughout the bond alloy along with the titanium carbide particulate, the diamond being present in an amount of 100 concentration (or about 25% by volume of the tool being diamond particulate).

TABLE

| | Bond Alloys | | | | |
|---|---|---|---|---|---|
| Tool # | Cu | Sn | Co | Ag | TiC |
| 10 | 73.5 | 26.5 | — | — | 0 |
| 11 | 71.0 | 24.0 | — | — | 5 |
| 12 | 68.5 | 21.5 | — | — | 10 |
| 13 | 63.5 | 16.5 | — | — | 20 |
| 20 | 34 | 13 | 48 | 5 | 0 |
| 21 | 34 | 13 | 47 | 5 | 1 |
| 22 | 34 | 13 | 43 | 5 | 5 |

Tool #'s 10 and 20 are reference tools against which the honing capability of the other tools is compared and they are not considered part of the present invention.

The tools were made by conventional hot pressing procedures, including a mixing step, cold compaction step and hot compaction step. In particular, the process for making the tools consisted of the following detailed steps:

(a) The elemental metallic powders, TiC powder and diamond particulate were measured out and tumble mixed in a conventional drum mixer for 24 hours. The metallic powders had a particle size of minus 325 mesh while the TiC and diamond particulate had a particle size of minus 325 mesh and 140/170 mesh, respectively.

(b) A conventional high speed steel (T-1) die with a rectangular cavity and having a punch was filled with the appropriate amount of powder premixed in step (a).

(c) The powder was cold compacted in the die at 10 TSI (tons per square inch) in a conventional hydraulic press.

(d) The punch/die assembly with cold compacted powder therein was placed in a furnace having a nitrogen or other inert atmosphere and heated to about 1325° F. for 1 hour.

(e) The heated punch/die assembly was removed from the furnace and immediately compacted at a sufficient punch pressure to compact the powder to a density of 8.60 g/ml.

(f) After hot compaction, the punch/die assembly is air cooled to room temperature under punch pressure in the press.

(g) Then, the room temperature assembly is removed from the press and the compacted powder tool is removed.

(h) The compacted tool is then ground true and to size if necessary.

The honing tools thus made were tested in laboratory honing experiments as follows:

Cylindrical specimens of cast iron simulating engine block cast iron were provided in 6-inch lengths with a 3½ inch diameter bore therethrough. Honing tests were performed on a Model #728 honing machine manufactured by Micromatic Division of Ex-Cell-O Corporation, Troy, Mich. Prior to honing, the long dimension of the rectangular stones was measured to ±0.0001 inch and the specimen bore was measured to ±0.0005 inch. For honing, the Microdial® stone expander adjustment mechanism on the machine was set to expand or feed out the stones 0.018 inch in 6 minutes at a spindle speed of 360 RPM and reciprocation of 60 cycles/minute (one cycle=stone insertion pass and stone withdrawal pass). The honing tools were initially run in the specimen bore until the stones were satisfactorily seated. The actual honing test consisted of 5 travels of the Microdial stone expander, i.e., the stones were expanded 0.018 inch over 6 minutes five different times under the spindle speed and reciprocation conditions noted above. Thereafter, stone wear was measured to 0.0001 inch and specimen bore diameter was measured to 0.0005 inch after the tool and specimen were allowed to cool to room temperature. From the stone wear and specimen bore diameter changes, the ratio of cubic inches of stock (specimen) removal to cubic inches of stone wear (the well-known "G" ratio) was calculated.

The results of these tests are shown in the FIGURE which is a bar graph depicting abrasive loss per cycle of the honing process for each tool made.

It is apparent that addition of titanium carbide to the copper-tin bond alloy of tool #10 had a beneficial effect when titanium carbide additions are limited to less than 20$^{w}$/o. When the weight percent of titanium carbide was 5$^{w}$/o and 10$^{w}$/o, special beneficial effects were noted. For example, when 5$^{w}$/o titanium carbide was added, abrasive loss per cycle decreased from over 0.0004 for tool #10 to less than 0.0002 for tool #11 representing an increase in G ratio from 7,477.7 to 29,926.8. When 10$^{w}$/o titanium carbide was added, abrasive loss per cycle decreased from over 0.0004 to less than 0.0003 for tool #12 (increase in G ratio from 7,477.7 to 14,955.4) but was nevertheless higher than abrasive loss for tool #11 with 5$^{w}$/o titanium carbide. Tool #13 illustrates that titanium carbide must be limited to less than 20 weight percent to avoid an unacceptable increase in abrasive loss per cycle.

The beneficial effect of titanium carbide additions to the tools with copper-tin-cobalt-silver bond alloys is also illustrated in the FIGURE. For example, the addition of 1$^{w}$/o titanium carbide results in a decrease in abrasive loss from over 0.0002 for tool #20 to less than 0.0002 for tool #21 representing an increase in G ratio from 832.1 to 1869.4. Tool #22 with 5$^{w}$/o titanium carbide illustrates decreased abrasive loss per cycle but slightly higher than tool #21.

In these tests, it is apparent that tool #11 was substantially equivalent to tool #21 and tool #22. Since the latter tools contain substantial amounts of expensive cobalt and silver, tool #11 appears to offer a much lower cost alternative in some applications, at least involving honing of cast iron. Of course, honing of other materials such as hard steel may produce different results. In fact, honing of hard steel fuel nozzles showed tool #11 to be inferior to tools #20 and #21.

Abrasive tools of the present invention should have from about 0.5 to less than 20 weight percent titanium carbide dispersed in the bond alloy. Preferably, titanium carbide is present in amounts from about 1 to about 10 weight percent and, even more preferably from about 1 to about 5 weight percent based on total weight of the metal bond alloy (Cu-Sn or Cu-Sn-Co-Ag). These titanium carbide additions can made to various metal bond alloy compositions, a preferred metal alloy bond consisting essentially of from about 10 to 90 weight copper, 10–30 weight tin, up to about 50 weight percent cobalt and up to about 10 weight percent silver.

A particularly preferred metal bond alloy would have from about 70 to 80 weight percent copper and about 20 to 30 weight percent tin with titanium carbide present from about 1 to 5 weight percent based on total weight of copper and tin.

Another particularly preferred metal bond alloy would have about 20 to 30 weight percent copper, about 10 to 20 weight percent tin, about 40 to 50 weight percent cobalt and up to about 10 weight percent silver with titanium carbide present from about 1 to 5 weight percent based on the total weight of the metallic bond components.

Of course, in the above embodiments, cubic boron nitride could be used in lieu of the diamond particulate as the abrasive grit depending upon the material being honed and other sizes of particulate could be used.

Although the invention has been illustrated with respect to specific examples and preferred embodiments, it will be understood by those skilled in the art that various changes may be made therein within the scope of the appended claims which are intended to also include equivalents of such embodiments.

We claim:

1. An abrasive tool comprising a metal bond alloy of copper, tin and optionally cobalt, titanium carbide particulate present in the bond alloy in an amount from about 5 to about 10 weight percent of the total metal alloy weight and other abrasive particles in the bond alloy.

2. An abrasive tool comprising a metal bond alloy consisting essentially of about 10–90 weight percent copper, about 10–30 weight percent tin, up to about 50 weight percent cobalt and up to about 10 weight percent silver, titanium carbide particulate in the bond alloy in an amount from about 5 to about 10 weight percent of the total weight of the bond alloy matrix and abrasive particles selected from the group consisting of diamond and cubic boron nitride in the bond alloy.

3. An abrasive honing tool comprising a metal bond alloy consisting essentially of about 70 to 80 weight percent copper and about 20 to 30 weight percent tin, titanium carbide particulate dispersed in the bond alloy in an amount from about 5 to 10 weight percent of the total bond alloy weight and abrasive particles selected from the group consisting of diamond and cubic boron nitride in the bond alloy.

4. An abrasive honing tool comprising a metal bond alloy consisting essentially of about 20 to 30 weight percent copper, about 10 to 20 weight percent tin, about 40 to 50 weight percent cobalt and up to 10 weight percent silver, titanium carbide dispersed in the bond alloy in an amount from about 1 to 5 weight percent of the total bond allow weight, and abrasive particles selected from the group consisting of diamond and cubic boron nitride in the bonding alloy.

* * * * *